US009726993B2

(12) United States Patent
Yaoi et al.

(10) Patent No.: US 9,726,993 B2
(45) Date of Patent: Aug. 8, 2017

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Shinichi Yaoi, Kanagawa (JP); Yasushige Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/832,447

(22) Filed: Aug. 21, 2015

(65) Prior Publication Data

US 2016/0266506 A1 Sep. 15, 2016

(30) Foreign Application Priority Data

Mar. 9, 2015 (JP) ..... 2015-046255

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 9/113*** | (2006.01) |

(52) U.S. Cl.

CPC ..... *G03G 9/0819* (2013.01); *G03G 9/0827* (2013.01); *G03G 9/08755* (2013.01); *G03G 9/1132* (2013.01)

(58) Field of Classification Search

CPC ..... G03G 9/0819; G03G 9/0827; G03G 9/10
See application file for complete search history.

(56) References Cited

U.S. PATENT DOCUMENTS

| | | | | |
|---|---|---|---|---|
| 5,618,647 | A | 4/1997 | Kukimoto et al. | |
| 5,712,069 | A | 1/1998 | Baba et al. | |
| 2004/0038141 | A1* | 2/2004 | Yoshida | G03G 9/0819 430/108.3 |
| 2010/0279224 | A1 | 11/2010 | Okamoto et al. | |
| 2010/0316947 | A1* | 12/2010 | Mizuhata | C08J 3/05 430/109.4 |
| 2011/0065037 | A1* | 3/2011 | Iwatsuki | G03G 9/1075 430/108.3 |

(Continued)

FOREIGN PATENT DOCUMENTS

| | | | |
|---|---|---|---|
| JP | S63-235959 | A | 9/1988 |
| JP | H08-160671 | A | 6/1996 |

(Continued)

OTHER PUBLICATIONS

Diamond, "Handbook of Imaging Materials," Marcel Dekker, NY, NY 1991.*

*Primary Examiner* — Peter Vajda
(74) *Attorney, Agent, or Firm* — Oliff PLC

(57) ABSTRACT

An electrostatic charge image developing toner includes toner particles having a volume average particle diameter of 3 μm to 16 μm, wherein, when the toner particles having a particle diameter of 1.0 μm to 30.0 μm are set as T1, the toner particles having a particle diameter of 1.0 μm to 2.5 μm are set as T2, a rate of T2 to the toner particles is set as A, the toner particles having a particle diameter of 1.0 μm to 5 μm is set as T3 and a rate of T3 to the toner particles is set as B, the rate of T2 occupying T1 is from 10% by number to 40% by number and a fine particle ratio C represented by A/B is from 0.18 to 0.40.

18 Claims, 3 Drawing Sheets

(56) References Cited

U.S. PATENT DOCUMENTS

| | | | | |
|---|---|---|---|---|
| 2013/0196265 | A1 | 8/2013 | Kamae et al. | |
| 2013/0252164 | A1* | 9/2013 | Iida | G03G 9/09716 430/108.11 |

FOREIGN PATENT DOCUMENTS

| | | | |
|---|---|---|---|
| JP | H09-15901 | A | 1/1997 |
| JP | H09-160307 | A | 6/1997 |
| JP | 2005-270955 | A | 10/2005 |
| JP | 2005-309184 | A | 11/2005 |
| JP | 2009-151083 | A | 7/2009 |
| JP | 2011-158830 | A | 8/2011 |
| JP | 2013-178506 | A | 9/2013 |

* cited by examiner

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-046255 filed Mar. 9, 2015.

BACKGROUND

1. Technical Field

The present invention relates to an electrostatic charge image developing toner, an electrostatic charge image developer, and a toner cartridge.

2. Related Art

In recent years, an electrophotographic process has not only been used in a copying machine, but has also been widely used in a network printer in an office, a printer of a personal computer, a printer for print on demand, and the like according to the development of devices or improvement of a communication network in the information society, and not only black and white and color printing, but realization of high quality, high speed, high reliability, small scale, lightweight, and energy savings has been more strongly required.

In the electrophotographic process, a fixed image is generally formed through plural steps of electrically forming an electrostatic charge image on a photoreceptor (image holding member) using a photoconductive substance, with various units, developing this electrostatic charge image using a developer containing a toner, transferring a toner image on the photoreceptor to a recording medium such as paper through an intermediate transfer member or directly, and fixing this transferred image onto the recording medium.

SUMMARY

According to an aspect of the invention, there is provided an electrostatic charge image developing toner including:

toner particles having a volume average particle diameter of 3 μm to 16 μm, wherein, when the toner particles having a particle diameter of 1.0 μm to 30.0 μm are set as T1, the toner particles having a particle diameter of 1.0 μm to 2.5 μm are set as T2, a rate of T2 to the toner particles is set as A, the toner particles having a particle diameter of 1.0 μm to 5 μm is set as T3 and a rate of T3 to the toner particles is set as B, the rate of T2 occupying T1 is from 10% by number to 40% by number and a fine particle ratio C represented by A/B is from 0.18 to 0.40.

BRIEF DESCRIPTION OF THE DRAWINGS

Exemplary embodiments of the present invention will be described in detail based on the following figures, wherein.

DETAILED DESCRIPTION

Figure 1:
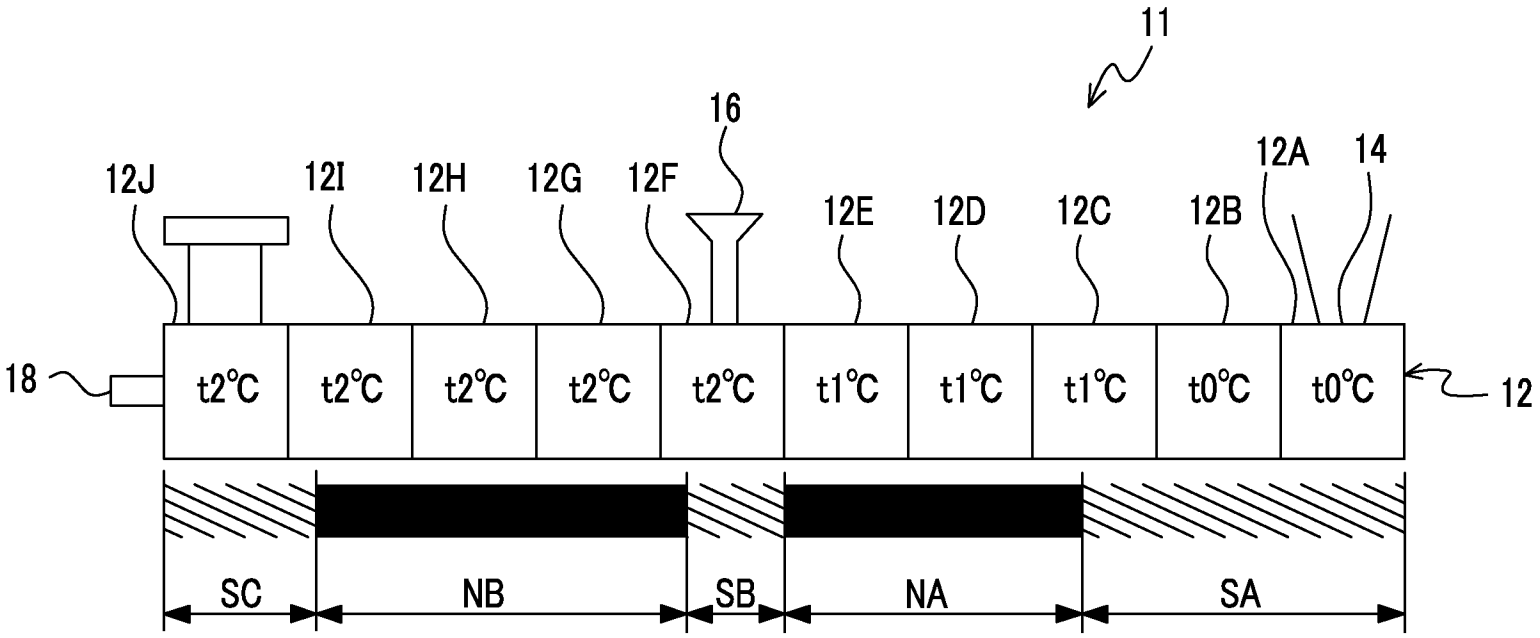
FIG. 1 is a diagram illustrating a screw state of an example of a screw extruder used in manufacturing a toner according to the exemplary embodiment.

Hereinafter, exemplary embodiments of an electrostatic charge image developing toner, an electrostatic charge image developer, a toner cartridge, a process cartridge, an image forming apparatus, and an image forming method will be described in detail.

Electrostatic Charge Image Developing Toner

An electrostatic charge image developing toner according to the exemplary embodiment (hereinafter, the electrostatic charge image developing toner is referred to as a "toner") contains toner particles, and an external additive containing silica particles having a volume average particle diameter of 7 nm to 20 nm and at least one kind selected from the group consisting of titania particles and alumina particles, in which a volume average particle diameter of the toner particles is from 3 μm to 16 μm, a rate of toner particles T2 having a particle diameter of 1.0 μm to 2.5 μm occupying toner particles T1 having a particle diameter of 1.0 μm to 30.0 μm in the toner particles is from 10% by number to 40% by number, when a rate of the toner particles T2 having a particle diameter of 1.0 μm to 2.5 μm to the toner particles is set as A and a rate of toner particles T3 having a particle diameter of 1.0 μm to 5.0 μm to the toner particles is set as B, a fine particle ratio C represented as A/B is from 0.18 to 0.40, and a rate of toner particles to which at least one kind selected from the group consisting of titania particles and alumina particles among the toner particles T2 having a particle diameter of 1.0 μm to 2.5 μm is attached, to the toner particles is from 10% by number to 100% by number.

According to the toner according to the exemplary embodiment, the number of deletion of a toner image is decreased. The reason therefor is not clear, but the following are assumed.

In an image forming apparatus using a two-component developer obtained by mixing the toner with a carrier, a carrier which is a magnetic material for charging the toner is used. An excellent toner image is obtained by stabilizing resistance and a charging state of the developer depending on a ratio of this toner and the carrier, that is, concentration of the toner. However, the carrier may be deteriorated with the use of the developer, and a low resistance part may be partially formed on the surface of the carrier due to peeling or abrasion of a resin coating layer from the surface of the carrier. As described above, when there is a part with low resistance of the carrier and the developer is highly charged due to unevenness of charging, the charge is injected to the carrier and so-called leakage easily occurs. When this leakage occurs, a potential of the surface of the photoreceptor is converged to a developing bias and developing contrast is not ensured, and thus deletion of the toner image may be formed. In addition, when the degree of the deletion becomes severe, the carrier is developed to forma white spot image. Such a problem easily occurs in a case where toner concentration is decreased due to toner stress to decrease the developer resistance and in a case where the charging state is uneven in an environment of a low temperature and low humidity (10° C. and 15% RH) to form a high charged part in the developer.

As a result of the investigation performed by the inventors, it is found that when the fine toner particles are mixed in the toner in the conditions of a given quantity, the deterioration of the developer at the time of stress due to a balance between a particle size of the toner used and a particle size of the replenished toner tends to be prevented. The reason therefor is not clear, but it is assumed that a function of preventing the deterioration of the carrier is continued to be exhibited, when the developer contains the fine toner particles which hardly receives stress, to some extent.

That is, since the fine toner particles having a particle diameter equal to or smaller than 2.5 μm are hardly developed, the fine toner particles are easily contained in the developer. Accordingly, by mixing the fine toner particles to which titania particles or alumina particles having a high effect of conductivity are intentionally attached, in the toner, it is possible to attach the fine toner particles in which titania particles or alumina particles are effectively attached to the carrier even at the time of stress. Therefore, voids formed due to peeling deterioration of the resin coating layer of the carrier are filled with titania particles and alumina particles. As a result, it is assumed that the local leakage when the peeling of the resin coating layer of the carrier is deteriorated and deletion formed due to carrier attachment may be prevented. Particularly, it is assumed that when local charge injection occurs even when the toner concentration in the developer is decreased in an environment of a low temperature and low humidity, the titania particles or the alumina particles which fills the voids release the charges and thus carrier attachment is prevented.

In the toner according to the exemplary embodiment, a rate of the toner particles T2 having a particle diameter of 1.0 μm to 2.5 μm occupying the toner particles T1 having a particle diameter of 1.0 μm to 30.0 μm in the toner particles is set to be from 10% by number to 40% by number. When the rate of the toner particles T2 having a particle diameter of 1.0 μm to 2.5 μm is less than 10% by number, deletion may not be decreased. Meanwhile, when the rate of the toner particles T2 having a particle diameter of 1.0 μm to 2.5 μm exceeds 40% by number, a problem regarding low density of an image may occur. The rate of the toner particles T2 having a particle diameter of 1.0 μm to 2.5 μm is preferably from 15% by number to 30% by number and more preferably from 20% by number to 30% by number In the toner according to the exemplary embodiment, when the rate of the toner particles T2 having a particle diameter of 1.0 μm to 2.5 μm to the toner particles is set as A and the rate of toner particles T3 having a particle diameter of 1.0 μm to 5.0 μm to the toner particles is set as B, a fine particle ratio C represented as A/B is set to be from 0.18 to 0.40. When the fine particle ratio C is less than 0.18, deletion may not be decreased. Meanwhile, when the fine particle ratio C exceeds 0.40, a problem regarding low density of an image may occur. The fine particle ratio C is preferably from 0.20 to 0.30 and more preferably from 0.23 to 0.27.

The fine particle ratio C of the toner particles obtained by a typical kneading and pulverizing method is equal to or smaller than 0.1, in many cases.

In the toner according to the exemplary embodiment, a rate of toner particles to which at least one kind selected from the group consisting of titania particles and alumina particles among the toner particles T2 having a particle diameter of 1.0 μm to 2.5 μm is attached, to the toner particles is set to be from 10% by number and 100% by number. When the rate of the toner particles to which at least one kind selected from the group consisting of titania particles and alumina particles is attached, is less than 10% by number, deletion may not be decreased. The rate of the toner particles to which at least one kind selected from the group consisting of titania particles and alumina particles is attached, is preferably from 20% by number to 100% by number and more preferably from 30% by number to 100% by number.

In the toner according to the exemplary embodiment, the number of particles of at least one kind selected from the group consisting of titania particles and alumina particles, attached to one toner particle T2 having a particle diameter of 1.0 μm to 2.5 μm is preferably from 1 to 100, more preferably from 10 to 100, and even more preferably from 30 to 100.

In the toner according to the exemplary embodiment, a volume average particle diameter of the toner particles is set to be from 3 μm to 16 μm. By setting the volume average particle diameter of the toner particles in the range described above, excellent toner quality is maintained and formation of deletion is effectively prevented. The volume average particle diameter of the toner particles is preferably from 5 μm to 14 μm, more preferably from 5 μm to 10 μm, and even more preferably from 5.5 μm to 8 μm.

In the exemplary embodiment, the volume average particle diameter of the toner particles and the rate of the toner particles T2 having a particle diameter of 1.0 μm to 2.5 μm and the fine particle ratio C are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% by weight aqueous solution of a surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 1 μm to 30 μm is measured by a Coulter Multisizer II using an aperture having an aperture diameter of 50 μm. 50,000 particles are sampled.

Cumulative distributions by volume and by number are drawn from the side of the smallest diameter with respect to particle size ranges (channels) separated based on the measured particle size distribution. The cumulative percentage (%) when the number average particle diameter is from 1.0 μm to 2.5 μm is set as A and the cumulative percentage (%) when the number average particle diameter is from 1.0 μm to 5.0 μm, the fine particle ratio C represented as a calculation expression of A/B=C is calculated. Cumulative distributions are drawn from the side of the smallest diameter, and the volume average particle diameter of the toner particles is defined as that corresponding to a particle diameter when the cumulative percentage becomes 50% based on volume. The rate of the toner particles T2 having a particle diameter of 1.0 μm to 2.5 μm is determined as a rate of the number of toner particles T2 having a particle diameter of 1.0 μm to 2.5 μm, when the number of particles having a particle diameter of 1 μm to 30 μm is 100% by number.

In the exemplary embodiment, the rate of toner particles to which at least one kind selected from the group consisting of titania particles and alumina particles among the toner particles T2 having a particle diameter of 1.0 μm to 2.5 μm is attached to the toner particles, is set as a value calculated as follows.

The toner is observed using an electron microscope (S4700 manufactured by Shimadzu Corporation) and presence or absence of particles other than silica particles which are present on the surface of the toner particles having a particle diameter of 1.0 μm to 2.5 μm, is checked. The presence or absence of particles which are not silica particles is checked for 100 toner particles T2 having a particle diameter of 1.0 μm to 2.5 μm and a rate of the toner particles where particles other than silica particles are present is calculated.

The number of particles which are present on the surface of the toner particles T2 having a particle diameter of 1.0 μm to 2.5 μm and are not silica particles, is counted. 100 toner particles T2 having a particle diameter of 1.0 μm to 2.5 μm are counted in the same manner, and an average value thereof is set as the number of particles of at least one kind selected from the group consisting of titania particles and alumina particles, attached to one toner particle T2 having a particle diameter of 1.0 μm to 2.5 μm.

Hereinafter, the toner according to the exemplary embodiment will be described in detail.

The toner according to the exemplary embodiment contains toner particles and an external additive.

Toner Particles

The toner particles, for example, contains a binder resin, and if necessary, a colorant, a release agent, and other additives.

Binder Resin

Examples of the binder resins include a homopolymer consisting of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These binder resins may be used singly or in combination with two or more kinds thereof.

As the binder resin, a polyester resin is preferable.

As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic dials and alicyclic dials are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used singly or in combination of two or more kinds thereof.

The glass transition temperature (Tg) of the polyester resin is preferably from 50° C. to 80° C., and more preferably from 50° C. to 65° C.

The glass transition temperature is determined by a DSC curve obtained by differential scanning calorimetry (DSC), and more specifically, is determined by "extrapolation glass transition starting temperature" disclosed in a method of acquiring the glass transition temperature of JIS K-7121-1987 "Testing Methods for Transition Temperature of Plastics".

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

Further, the weight average molecular weight and the number average molecular weight are measured by gel permeation chromatography (GPC). The molecular weight measurement by GPC is performed using a GPC, HLC-8120 GPC manufactured by Tosoh Corporation, as a measuring device, a column, TSK gel Super HM-M (15 cm) manufactured by Tosoh Corporation, and a THF solvent. The weight average molecular weight and the number average molecular weight are calculated using a molecular weight calibration curve obtained from a monodisperse polystyrene standard sample from the results of the above measurement.

A known manufacturing method is applied to manufacture the polyester resin. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is, for example, preferably from 40% by weight to 95% by weight, more preferably from 50% by weight to 90% by weight, and still more preferably from 60% by weight to 85% by weight, with respect to the entire toner particles.

Colorant

Examples of the colorant include pigments such as carbon black, chrome yellow, Hansa yellow, benzidine yellow, thuren yellow, quinoline yellow, pigment yellow, permanent orange GTR, pyrazolone orange, Balkan orange, watch young red, permanent red, brilliant carmin 3B, brilliant carmin 6B, DuPont oil red, pyrazolone red, lithol red, Rhodamine B Lake, Lake Red C, pigment red, rose bengal, aniline blue, ultramarine blue, chalco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more kinds thereof.

If necessary, a surface-treated colorant may be used as the colorant, and the colorant may be used in combination with a dispersant. Further, a combination of plural kinds of the colorants may be used.

The content of the colorant is, for example, preferably from 1% by weight to 30% by weight, and more preferably from 3% by weight to 15% by weight, with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K-7121-1987.

The content of the release agent is, for example, preferably from 1% by weight to 20% by weight, and more preferably from 5% by weight to 15% by weight, with respect to the entire toner particles.

Other Additives

Examples of other additives include known additives such as a magnetic material, a charge-controlling agent, and an inorganic powder. These additives are included as internal additives in the toner particles.

Characteristics of Toner Particles

The toner particles may be toner particles having a single layer structure, or toner particles having a so-called core-shell structure composed of a core (core particle) and a coating layer (shell layer) that is coated on the core.

Here, the toner particles having a core-shell structure may preferably be composed of, for example, a core configured to include a binder resin, and if necessary, other additives such as a colorant and a release agent, and a coating layer configured to include a binder resin.

The shape factor SF1 of the toner particles is preferably from 110 to 150, and more preferably from 120 to 140.

Furthermore, the shape factor SF1 is determined by the following equation:

Equation: $SF1=(ML^2/A)\times(\pi/4)\times 100$

In the equation, ML represents an absolute maximum length of a toner particle and A represents a projected area of a toner particle.

Specifically, the shape factor SF1 is calculated as follows mainly using a microscopic image or an image of a scanning electron microscope (SEM) that is analyzed using an image analyzer to be digitalized. That is, an optical microscopic image of particles sprayed on the surface of a glass slide glass is captured into an image analyzer LUZEX through a video camera, the maximum lengths and the projected areas of 100 particles are obtained for calculation using the above-described equation, and an average value thereof is obtained.

External Additives

In the exemplary embodiment, an external additive containing silica particles having a volume average particle diameter of 7 nm to 20 nm and at least one kind selected from the group consisting of titania particles and alumina particles is used, as the external additive. The volume average particle diameter of the silica particles is preferably from 7 nm to 18 nm and more preferably from 7 nm to 15 nm.

A compound ratio of the silica particles having a volume average particle diameter of 7 nm to 20 nm based on weight of the total of at least one kind selected from the group consisting of titania particles and alumina particles and (silica particles/total of at least one kind selected from the group consisting of titania particles and alumina particles) is preferably from 0.2 to 5.0, more preferably from 0.5 to 3.0, and even more preferably from 1.0 to 2.0.

A volume average particle diameter of the titania particles is preferably from 30 nm to 200 nm and more preferably from 40 nm to 100 nm.

A volume average particle diameter of the alumina particles is preferably from 30 nm to 200 nm and more preferably from 40 nm to 100 nm.

Examples of other external additives include CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

It is preferable that the surfaces of the inorganic particles as the external additive are subjected to a hydrophobizing treatment. For example, the hydrophobizing treatment is performed, by immersing the inorganic particles in a hydrophobizing agent. The hydrophobizing agent is not particularly limited and examples thereof include a silane coupling agent, silicone oil, a titanate coupling agent and an aluminum coupling agent. These may be used singly or in combination of two or more kinds thereof.

For example, the amount of the hydrophobizing agent is from 1 part by weight to 10 parts by weight with respect to 100 parts by weight of the inorganic particles.

Examples of the external additives also include resin particles (resin particles such as polystyrene, polymethyl methacrylate (PMMA), and a melamine resin) and a cleaning aid (for example, a metal salt of higher fatty acid represented by zinc stearate and a particle of a fluorine polymer).

The amount of the external additive externally added is, for example, preferably from 0.01% by weight to 5% by weight, and more preferably from 0.01% by weight to 3.0% by weight, with respect to the toner particles.

Method of Preparing Toner

Next, a method for preparing the toner according to the present exemplary embodiment will be described.

The toner according to the present exemplary embodiment is obtained by preparing toner particles and then externally adding an external additive to the toner particles.

The toner particles may be prepared, by any of a dry production method (for example, kneading and pulverizing method) and a wet production method (for example, a aggregation and coalescence method, a suspension polymerization method, and a dissolution suspension method). The method of preparing the toner particles is not limited thereto and a known method may be employed.

Specifically, for example, in the case where the toner particles are prepared using the aggregation and coalescence method, the toner particles are prepared through:

a step of preparing a resin particle dispersion in which resin particles which become a binder resin are dispersed (resin particle dispersion preparing step);

a step of forming aggregated particles by aggregating the resin particles (as necessary, other particles) in the resin particle dispersions (as necessary, in the dispersion after other particle dispersion is mixed) (aggregated particle forming step); and a step of forming toner particles by heating the aggregated particle dispersion in which the aggregated particles are dispersed to coalesce the aggregated particles (aggregation and coalescence step).

Hereafter, the details on each of the steps will be described.

Further, while a method of obtaining toner particles containing a colorant and a release agent will be described in the following description, the colorant and the release agent are used, as necessary. Additional additives other than the colorant and the release agent may, of course, be used.

Resin Particle Dispersion Preparing Step

First, along with a resin particle dispersion in which resin particles which become a binder resin are dispersed, a colorant particle dispersion in which colorant particles are dispersed, and a release agent particle dispersion in which release agent particles are dispersed are prepared.

Here, the resin particle dispersion is prepared, for example, by dispersing resin particles in a dispersion medium by a surfactant.

An example of the dispersion medium used in the resin particle dispersion includes an aqueous medium.

Examples of the aqueous medium include water such as distilled water and ion exchange water, and alcohols and the like. These may be used singly or in combination of two or more kinds thereof.

Examples of the surfactant include anionic surfactants such as sulfuric ester salts, sulfonates, phosphoric esters and soap surfactants; cationic surfactants such as amine salts and quaternary ammonium salts; and nonionic surfactants such as polyethylene glycol, alkylphenol ethylene oxide adducts and polyols. Among these, particularly, anionic surfactants and cationic surfactants are preferable. The nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno mill having media is exemplified. In addition, the resin particles may be dispersed in a resin particle dispersion, for example, by a phase inversion emulsification method.

Incidentally, the phase inversion emulsification method is a method in which a resin to be dispersed is dissolved in a hydrophobic organic solvent capable of dissolving the resin, a base is added to the organic continuous phase (O phase) to neutralize the resin, an aqueous medium (W phase) is added to invert the resin into a discontinuous phase (so-caller inversed phase): from W/O to O/W, so that the resin may be dispersed in the form of particles in the aqueous medium.

The volume average particle diameter of the resin particles dispersed in the resin particle dispersions is preferably, for example, from 0.01 μm to 1 μm, more preferably from 0.08 μm to 0.8 μm, and even more preferably from 0.1 μm to 0.6 μm.

In addition, the volume average particle diameter of the resin particles is measured such that using the particle diameter distribution measured by a laser diffraction particle diameter distribution analyzer (for example, LA-700, manufactured by Horiba Seisakusho Co., Ltd.), a cumulative distribution is drawn from the small diameter side with respect to the volume based on the divided particle diameter ranges (channels) and the particle diameter at which the cumulative volume distribution reaches 50% of the total particle volume is defined as a volume average particle diameter D50v. Further, the volume average particle diameter of particles in the other dispersion will be measured in the same manner.

For example, the content of the resin particles contained in the resin particle dispersion is preferably from 5% by weight to 50% by weight, and more preferably from 10% by weight to 40% by weight.

Moreover, for example, the colorant particle dispersion, and the release agent particle dispersion are prepared in a manner similar to the resin particle dispersion. That is, with respect to the dispersion medium, the dispersion method, the volume average particle diameter of the particles, and the content of the particles in the resin particle dispersion, the same is applied to the colorant particles dispersed in the colorant particle dispersion and the release agent particles dispersed in the release agent particle dispersion.

Aggregated Particle Forming Step

Next, the resin particle dispersion is mixed with the colorant particle dispersion, and the release agent particle dispersion.

Further, in the mixed dispersion, the resin particles, the colorant particles, and the release agent particle are hetero-aggregated to form aggregated particles containing the resin particles, the colorant particles, and the release agent particles, which have an approximately targeted particle diameter of the toner particles.

Specifically, for example, an aggregation agent is added to the mixed dispersion, and the pH of the mixed dispersion is adjusted to be acidic (for example, a pH ranging from 2 to 5). As necessary, a dispersion stabilizer is added thereto, followed by heating to the glass transition temperature of the resin particles (specifically, from the temperature 30° C. lower than the glass transition temperature of the resin particles to the temperature 10° C. lower than the glass transition temperature). The particles dispersed in the mixed dispersion are aggregated to form aggregated particles.

In the aggregated particle forming step, for example, the aggregation agent is added to the mixed dispersion while stirring using a rotary shear type homogenizer at room temperature (for example, 25° C.), and the pH of the mixed dispersion is adjusted to be acidic (for example, a pH ranging from 2 to 5). As necessary, a dispersion stabilizer may be added thereto, followed by heating.

Examples of the aggregation agent include a surfactant having a polarity opposite to the polarity of the surfactant used as the dispersant which is added to the mixed dispersion, an inorganic metal salt and a divalent or higher-valent metal complex. In particular, when a metal complex is used as an aggregation agent, the amount of the surfactant used is reduced, which results in improvement of charging properties.

An additive for forming a complex or a similar bond with a metal ion in the aggregation agent may be used, as necessary. As the additive, a chelating agent is suitably used.

Examples of the inorganic metal salt include metal salts such as calcium chloride, calcium nitrate, barium chloride, magnesium chloride, zinc chloride, aluminum chloride, and aluminum sulfate, and polymers of inorganic metal salts such as polyaluminum chloride, polyaluminum hydroxide and calcium polysulfide.

As the chelating agent, a water-soluble chelating agent may be used. Examples of the chelating agent include oxycarboxylic acids such as tartaric acid, citric acid and gluconic acid, iminodiacetic acid (IDA), nitrilotriacetic acid (NTA), and ethylenediamine tetraacetic acid (EDTA).

The amount of the chelating agent added is, for example, preferably from 0.01 part by weight to 5.0 parts by weight, and more preferably from 0.1 part by weight to less than 3.0 parts by weight with respect to 100 parts by weight of the resin particles.

Aggregation and Coalescence Step

Next, the aggregated particles are coalesced by heating the aggregated particle dispersion in which the aggregated particles are dispersed up to, for example, a temperature from the glass transition temperature of the resin particles (for example, 10° C. to 30° C. higher than the glass transition temperature of the resin particles) or higher, thereby forming toner particles.

The toner particles are obtained by the above-described steps.

Further, the toner particles may also be prepared through a step in which after obtaining an aggregated particle dispersion in which the aggregated particles are dispersed, the aggregated particle dispersion is further mixed with a resin particle dispersion in which the resin particles are dispersed, and further aggregated to adhere the resin particles onto the surface of the aggregated particles, thereby forming, second aggregated particles; and a step in which a second aggregated particle dispersion in which the second aggregated particles are dispersed is heated to coalesce the second aggregated particles, thereby forming toner particles having a core-shell structure.

Here, after completion of the aggregation and coalescence step, the dried toner particles are obtained by subjecting the toner particles formed in the solution to a washing step, a solid-liquid separation step, and a drying step, as known in the art.

The washing step may be preferably sufficiently performed by a replacement washing with ion exchange water in terms of charging properties. The solid-liquid separation step is not particularly limited but may be preferably performed by filtration under suction or pressure in terms of productivity. The drying step is not particularly limited but may be preferably performed by freeze-drying, flash ejection drying, fluidized drying or vibration fluidized drying in terms of productivity.

A kneading and pulverizing method is a method of mixing each material such as the binder resin and then melting and kneading the material using a kneader and an extruder, performing coarse pulverizing of the obtained melted and kneaded material, and then performing pulverization using a jet mill, and obtaining toner particles having a particle diameter in a target range by a wind classifier.

More specifically, the kneading and pulverizing method is divided into a kneading step of kneading the toner forming material containing the binder resin and a pulverizing step of pulverizing the kneaded material. If necessary, other steps such as a cooling step of cooling the kneaded material formed in the kneading step may be included.

Each step relating to the kneading and pulverizing method will be described in detail.

Kneading Step

In the kneading step, the toner forming materials containing the binder resin are kneaded.

In the kneading step, it is desired to add 0.5 parts by weight to 5 parts by weight of an aqueous medium (for example, water such as distilled water or ion exchange water, and alcohols) with respect to 100 parts by weight of toner forming material.

Examples of a kneading machine used in the kneading step include a single screw extruder, a twin screw extruder, and the like. Hereinafter, a kneading machine including a sending screw portion and two kneading portions will be described as an example of the kneading machine with reference to the drawing, but it is not limited thereto.

FIG. 1 is a diagram illustrating a screw state of an example of a screw extruder that is used in the kneading step of the method of preparing the toner according to the exemplary embodiment.

A screw extruder 11 is constituted by a barrel 12 provided with a screw (not shown), an injection port 14 through which a toner forming material that is a raw material of the toner is injected to the barrel 12, a liquid addition port 16 for adding an aqueous medium to the toner forming material in the barrel 12, and a discharge port 18 through which the kneaded material formed by kneading the toner forming material in the barrel 12 is discharged.

In order from a portion close to the injection port 14, the barrel 12 is divided into a sending screw portion SA which transports the toner forming material which is injected from the injection port 14 to a kneading portion NA, the kneading portion NA for melting and kneading the toner forming material by a first kneading step, a sending screw portion SB which transports the toner forming material which is melted and kneaded in the kneading portion NA to a kneading portion NB, the kneading portion NB which is for melting and kneading the toner forming material by a second kneading step to form a kneaded material, and a sending screw portion SC which transports the formed kneaded material to the discharge port 18.

In addition, in the barrel 12, a different temperature controller (not shown) is provided for each block. That is, the temperatures of blocks 12A to 12J may be controlled to be different from each other. FIG. 1 shows a state in which the temperatures of the blocks 12A and 12B are controlled to t0° C., the temperatures of the blocks 12C to 12E are controlled to t1° C., and the temperatures of the blocks 12F to 12J are controlled to t2° C. Therefore, the toner forming material in the kneading portion NA is heated to t1° C., and the toner forming material in the kneading portion NB is heated to t2° C.

When the toner forming material containing a binder resin, a colorant, if necessary, a release agent and the like is supplied to the barrel 12 from the injection port 14, the sending screw portion SA sends the toner forming material to the kneading portion NA. At this time, since the temperature of the block 12C is set to t1° C., the toner forming material melted by heating is fed to the kneading portion NA. In addition, since the temperatures of the blocks 12D and 12E are also set to t1° C., the toner forming material is melted and kneaded at a temperature of t1° C. in the kneading portion NA. The binder resin and the release agent are melted in the kneading portion NA and subjected to shearing with the screw.

Next, the toner forming material kneaded in the kneading portion NA is sent to the kneading portion NB by the sending screw portion SB.

In the sending screw portion SB, an aqueous medium is added to the toner forming material by injecting the aqueous medium to the barrel 12 from the liquid addition port 16. In FIG. 1, the aqueous medium is injected in the sending screw portion SB, but the invention is not limited thereto. The aqueous medium may be injected in the kneading portion NB, or may be injected in both of the sending screw portion SB and the kneading portion NB. That is, the position at which the aqueous medium is injected and the number of injection positions are selected as necessary.

As described above, due to the injection of the aqueous medium to the barrel 12 from the liquid addition port 16, the toner forming material in the barrel 12 and the aqueous medium are mixed, and the toner forming material is cooled by evaporative latent heat of the aqueous medium, whereby the temperature of the toner forming material is maintained.

Finally, the kneaded material formed by being melted and kneaded by the kneading portion NB is transported to the discharge port 18 by the sending screw portion SC, and is discharged from the discharge port 18.

By doing so, the kneading step using the screw extruder 11 shown in FIG. 1 is performed.

Cooling Step

The cooling step is a step of cooling the kneaded material which is formed in the kneading step, and in the cooling step, it is preferable to cool the kneaded material to 40° C. or lower from a temperature of the kneaded material at the time of completing the kneading step, at an average temperature falling rate of 4° C./sec or more. When the cooling rate of the kneaded material is slow, the mixture which is finely dispersed in the binder resin in the kneading step (a mixture of a colorant and the internal additive such as a release agent which is, if necessary, internally added to the toner particle) may be recrystallized and a dispersion diameter may become large. Meanwhile, it is preferable to perform rapid cooling at the average temperature falling rate, since the dispersed state immediately after completion of the kneading step is maintained as it is. The average temperature falling rate is an average value of a rate of the temperature falling from the temperature (for example, t2° C. when using the screw extruder 11 of FIG. 1) of the kneaded material at the time of completing the kneading step to 40° C.

In detail, as a cooling method of the cooling step, a method of using a rolling roll in which cold water or brine is circulated and an insert type cooling belt is used. When performing the cooling using the method described above, a cooling rate thereof is determined by a rate of the rolling roll, a flow rate of the brine, a supplied amount of the kneaded material, a slab thickness at the time of rolling the kneaded material, and the like. The slab thickness is preferably from 1 mm to 3 mm.

Pulverizing Step

The kneaded material cooled through the cooling step is pulverized through the pulverizing step to form toner particles. In the pulverizing step, for example, a mechanical pulverizer, a jet pulverizer or the like is used. The pulverized material may have a spherical shape due to heat or a mechanical impact force.

Classification Step

If necessary, the toner particles obtained through the pulverization step may be classified through a classification step in order to obtain toner particles having a volume average particle diameter in a target range. In the classification step, a centrifugal classifier, an air classifier or the like, that have been used in the past, is used, and fine particles (toner particles having a particle diameter smaller than the target range) and coarse particles (toner particles having a particle diameter larger than the target range) are removed.

In the exemplary embodiment, when performing a test using the toner prepared by the kneading and pulverizing method, IDS-2 type collision plate type pulverizer (manufactured by Nippon Pneumatic Mfg. Co., Ltd.) may be used in the pulverizing and Elbow-Jet Air Classifier (manufactured by MATSUBO Corporation) may be used in the classification. Herein, in the pulverizing step, it is found that the particle diameter of the toner becomes minute and fine, when pulverizing pressure is increased or a processing amount is reduced, and it is possible to adjust the rate of the particle diameter of the toner particles T1 and the particle diameter of the toner particles T2 to become large. Next, in the classification step, by adjusting the rate of the toner particles T2 by changing a classification edge position, the fine particle ratio C may be adjusted.

External Addition Step

Inorganic particles represented by silica, titania, or aluminum oxide, may be added and attached to the obtained toner particles, in order to realize charging adjustment, fluidity application, and charge exchange property application. The external addition conditions of the external additive to the toner particles will be described later.

Sieving Step

If necessary, a sieving step may be provided after the above-described external addition step. Specifically, as a sieving method, for example, a gyro shifter, a vibrating sieving machine, a wind power sieving machine or the like is used. Through sieving, coarse particles of the external additive and the like are removed, and thus the formation of stripes on the photoreceptor and trickling down contamination in the apparatus are prevented.

In the exemplary embodiment, the method of preparing the toner particles is not particularly limited, but the toner particles are preferably prepared by the kneading and pulverizing method, in order to easily widen particle size distribution and to easily increase an amount of fine powder while increasing the volume average particle diameter of the toner particles.

The toner according to the exemplary embodiment is prepared by, for example, adding the external additive to the dry toner particles that have been obtained, followed by mixing. The mixing is preferably performed with, for example, a V-blender, a Henschel mixer, a Lödige mixer, or the like. Furthermore, if necessary, coarse toner particles may be removed using a vibration sieving machine, a wind-power sieving machine, or the like.

As another method of adding the external additive to the toner particles, a method of dispersing the toner particles in aqueous liquid such as water or water/alcohol, adding the external additive to the toner particles in a slurry state, and drying the mixture to attaching the external additive to the surface of the toner particle is exemplified. The additive slurry may be dried while spraying the additive slurry to the toner particles in a dry state.

When preparing the toner by adding and mixing the external additive to the toner particles, a method of first mixing at least one kind of external additive selected from the group consisting of titania particles and alumina particles and the toner with each other, and injecting silica particles may be used. By mixing at least one kind selected from the group consisting of titania particles and alumina particles with the toner particles for the longer time than the mixing time of the silica, powder properties obtained by adding the silica particles are not damaged, and a proper amount of at least one kind selected from the group consisting of titania particles and alumina particles may be disposed on the toner particles T2 having a particle diameter of 1.0 μm to 2.5 μm.

Electrostatic Charge Image Developer

An electrostatic charge image developer according to the exemplary embodiment includes the toner according to the exemplary embodiment and a carrier.

There is no particular limitation to the carrier and examples of the carrier include known carriers. Examples of the carrier include a coated carrier in which the surface of a core, for example, made of a magnetic powder, is coated with a coating resin; a magnetic powder dispersed carrier in which a magnetic powder is dispersed and blended in a matrix resin; and a resin impregnated carrier in which a porous magnetic powder is impregnated with a resin.

Incidentally, the magnetic powder dispersed carrier and the resin impregnated carrier may be carriers each having the constitutional particle of the carrier as a core and a coating resin coating the core.

Examples of the magnetic powder include magnetic metals such as iron, nickel, and cobalt; and magnetic oxides such as ferrate and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, in order to coat the surface of the core with the resin, a coating method using a coating resin and a coating layer forming solution in which various kinds of additives (used as necessary) are dissolved in an appropriate solvent may be used. The solvent is not particularly limited and may be selected depending on a coating resin to be used and application suitability.

Specific examples of the resin coating method include an dipping method of dipping a core in a coating layer forming solution, a spray method of spraying a coating layer forming solution to the surface of a core, a fluidized-bed method of spraying a coating layer forming solution to a core while the core is suspended by a fluidizing air, and a kneader coater method of mixing a core of a carrier with a coating layer forming solution in a kneader coater, and then removing the solvent.

As the other resin coating method, a method of performing dry compounding by applying mechanical impact to the mixture of a core and a coating layer formation resin is exemplified. In the dry compounding, a dry mixer NOBILTA NOB130 (manufactured by Hosokawa Micron Corporation) or the like may be used.

In the exemplary embodiment, a coating carrier is preferably used.

A volume average particle diameter of the carrier is preferably from 15 μm to 50 μm, more preferably from 20 μm to 45 μm, and even more preferably from 30 μm to 40 μm. By setting the volume average particle diameter of the carrier to be from 15 μm to 50 μm, excellent image quality is obtained and deletion of the toner image is reduced.

In the same manner as in the case of the toner particles, the volume average particle diameter of the carrier is measured using a Coulter Multisizer II (manufactured by Beckman Coulter, Inc.) When measuring the volume average particle diameter of the carrier, a particle size distribution of particles having a particle diameter of 2 μm to 60 μm is measured by a Coulter Multisizer II using an aperture having an aperture diameter of 100 μm.

In the two-component developer, a mixing ratio (weight ratio) of the toner and the carrier (toner:carrier) is preferably 1:100 to 30:100, and more preferably 3:100 to 20:100.

Image Forming Apparatus and Image Forming Method

An image forming apparatus and an image forming method according to the present exemplary embodiment will be described.

The image forming apparatus according to the present exemplary embodiment includes an image holding member; a charging unit that charges the surface of the image holding member; an electrostatic charge image forming unit that forms an electrostatic charge image on the surface of the charged image holding member; a developing unit that accommodates an electrostatic charge image developer, and develops the electrostatic charge image formed on the surface of the image holding member as a toner image using the electrostatic charge image developer; a transfer unit that transfers the toner image formed on the surface of the image holding member onto the surface of a recording medium; and a fixing unit that fixes the toner image transferred onto the surface of the recording medium. Further, as the electrostatic charge image developer, the electrostatic charge image developer according to the present exemplary embodiment is applied.

In the image forming apparatus according to the present exemplary embodiment, an image forming method (an image forming method according to the present exemplary embodiment) including a charging step of charging the surface of an image holding member; an electrostatic charge image forming step of forming an electrostatic charge image on the surface of the charged image holding member; a developing step of developing the electrostatic charge image formed on the surface of the image holding member as a toner image using the electrostatic charge image developer according to the present exemplary embodiment; a transfer step of transferring the toner image formed on the surface of the image holding member onto the surface of a recording medium; and a fixing step of fixing the toner image transferred onto the surface of the recording medium is carried out.

As the image forming apparatus according to the present exemplary embodiment, known image forming apparatuses such as a direct transfer type image forming apparatus which directly transfers a toner image formed on the surface of an image holding member onto a recording medium; an intermediate transfer type image forming apparatus which primarily transfers a toner image formed on the surface of an image holding member onto the surface of an intermediate transfer member and secondarily transfers the toner image transferred on the surface of the intermediate transfer member onto the surface of a recording medium; an image forming apparatus including a cleaning unit which cleans the surface of an image holding member before charged and after a toner image is transferred; and an image forming apparatus including an erasing unit which erases a charge from the surface of an image holding member before charged and after a toner image is transferred by irradiating the surface with easing light is applied.

In the case of the intermediate transfer type apparatus, for example, a configuration in which a transfer unit includes an intermediate transfer member in which a toner image is transferred onto the surface, a primary transfer unit which primarily transfers the toner image formed on the surface of the image holding member onto the surface of the intermediate transfer member, and a secondary transfer unit which secondarily transfers the toner image transferred onto the surface of the intermediate transfer member onto the surface of a recording medium is applied.

In the image forming apparatus according to the present exemplary embodiment, for example, a portion including the developing unit may have a cartridge structure (process cartridge) which is detachable from the image forming apparatus. As the process cartridge, for example, a process cartridge provided with a developing unit which accommodates the electrostatic charge image developer according to the present exemplary embodiment is suitably used.

Hereafter, an example of the image forming apparatus according to the present exemplary embodiment will be described, but the invention is not limited thereto. Further, main components shown in the drawing will be described, and the descriptions of the other components will be omitted.

Figure 2:
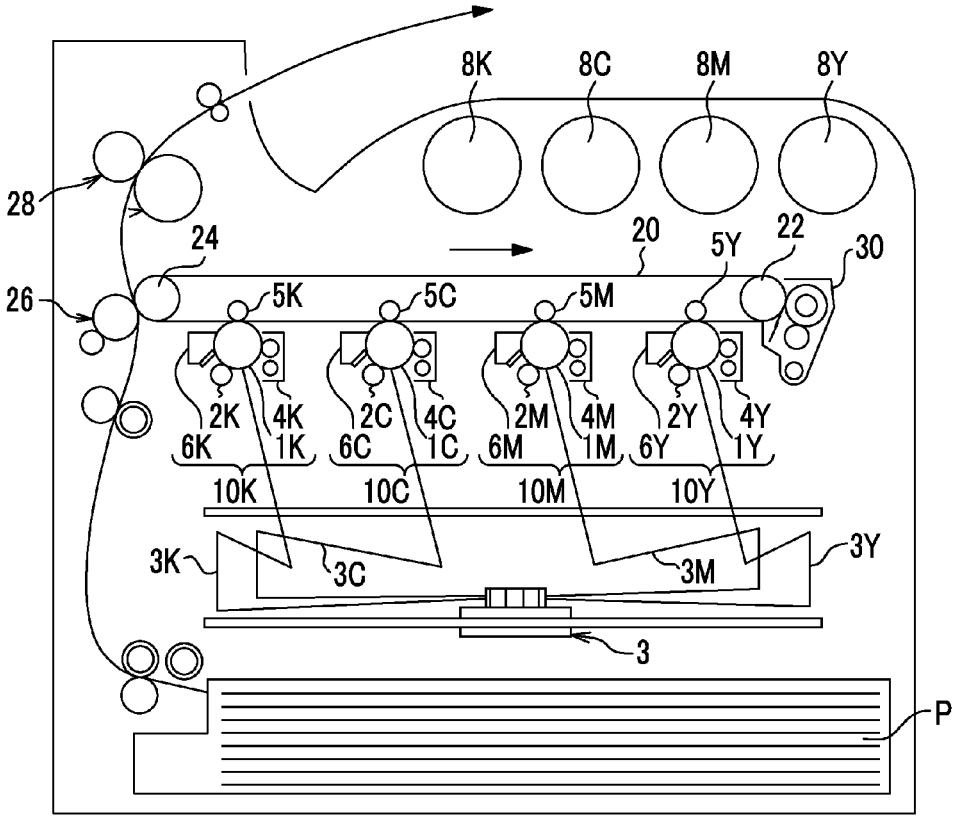
FIG. 2 is a schematic configuration diagram showing an example of an image forming apparatus according to the exemplary embodiment.

FIG. 2 is a schematic diagram showing a configuration of the image forming apparatus according to the exemplary embodiment.

The image forming apparatus shown in FIG. 2 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 is provided through each unit as an intermediate transfer member extending above each of the units 10Y, 10M, 10C, and 10K in the drawing. The intermediate transfer belt 20 is wound around a drive roller 22 and a support roller 24 coming into contact with the inner surface of the intermediate transfer belt 20, which are separated from each other from left to right in the drawing. The intermediate transfer belt 20 travels in a direction from the first unit 10Y to the fourth unit 10K. Incidentally, the support roller 24 is pushed in a direction moving away from the drive roller 22 by a spring or the like which is not shown, such that tension is applied to the intermediate transfer belt 20 which is wound around the support roller 24 and the drive roller 22. Further, on the surface of the image holding member side of the intermediate transfer belt 20, an intermediate transfer member cleaning device 30 is provided opposing the drive roller 22.

In addition, toners in the four colors of yellow, magenta, cyan and black, which are accommodated in toner cartridges 8Y, 8M, 8C, and 8K, respectively, are supplied to developing devices (developing units) 4Y, 4M, 4C, and 4K of the units 10Y, 10M, 10C, and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example. Further, the same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y includes a photoreceptor 1Y functioning as the image holding member. In the surroundings of the photoreceptor 1Y, there are successively disposed a charging roller (an example of the charging unit) 2Y for charging the surface of the photoreceptor 1Y to a predetermined potential; an exposure device (an example of the electrostatic charge image forming unit) 3 for exposing the charged surface with a laser beam 3Y based on a color-separated image signal to form an electrostatic charge image; the developing device (an example of the developing unit) 4Y for supplying a charged toner into the electrostatic charge image to develop the electrostatic charge image; a primary transfer roller (an example of the primary transfer unit) 5Y for transferring the developed toner image onto the intermediate transfer belt 20; and a photoreceptor cleaning device (an example of the cleaning unit) 6Y for removing the toner remaining on the surface of the photoreceptor 1Y after the primary transfer.

Further, the primary transfer roller 5Y is disposed inside the intermediate transfer belt 20 and provided in the position facing the photoreceptor 1Y. Further, bias power supplies (not shown), which apply primary transfer biases, are respectively connected to the respective primary transfer rollers 5Y, 5M, 5C, and 5K. A controller (not shown) controls the respective bias power supplies to change the primary transfer bias values which are applied to the respective primary transfer rollers.

Hereafter, the operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by stacking a photosensitive layer on a conductive substrate (volume resistivity at 20° C.: $1\times10^{-6}$ Ωcm or lower). In general, this photosensitive layer has high resistance (resistance similar to that of general resin), and has properties in which, when irradiated with the laser beam 3Y, the specific resistance of a portion irradiated with the laser beam changes. Therefore, the laser beam 3Y is output to the charged surface of the photoreceptor 1Y through the exposure device 3 in accordance with yellow image data sent from the controller not shown. The laser beam 3Y is irradiated onto the photosensitive layer on the surface of the photoreceptor 1Y, and as a result, an electrostatic charge image having a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charged charge flows on the surface of the photoreceptor 1Y and, in contrast, when the charge remains in a portion which is not irradiated with the laser beam 3Y.

The electrostatic charge image which is thus formed on the photoreceptor 1Y is rotated to a predetermined development position along with the travel, of the photoreceptor 1Y. At this development position, the electrostatic charge image on the photoreceptor 1Y is developed and visualized as a toner image by the developing device 4Y.

The developing device 4Y accommodates, for example, the electrostatic charge image developer, which contains at least a yellow toner and a carrier. The yellow toner is frictionally charged by being stirred in the developing device 4Y to have a charge with the same polarity as that of a charge charged on the photoreceptor 1Y and is maintained on a developer roller (as an example of the developer holding member). When the surface of the photoreceptor 1Y passes through the developing device 4Y, the yellow toner is electrostatically attached to a latent image portion at which the charge is erased from the surface of the photoreceptor 1Y, and the latent image is developed with the yellow toner. The photoreceptor 1Y on which a yellow toner image is formed subsequently travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

Meanwhile, the toner remaining on the photoreceptor 1Y is removed and collected by the photoreceptor cleaning device 6Y.

Also, primary transfer biases to be applied respectively to the primary transfer rollers 5M, 5C, and 5K at the second unit 10M and subsequent units, are controlled similarly to the primary transfer bias of the first unit.

In this manner, the intermediate transfer belt 20 having a yellow toner image transferred thereonto from the first unit 10Y is sequentially transported through the second to fourth units 10M, 10C, and 10K, and toner images of respective colors are superimposed and multi-transferred.

The intermediate transfer belt 20 having the four-color toner images multi-transferred thereonto through the first to fourth units arrives at a secondary transfer portion which is configured with the intermediate transfer belt 20, the support roller 24 coming into contact with the inner surface of the intermediate transfer belt and a secondary transfer roller 26 (an example of the secondary transfer unit) disposed on the side of the image holding surface of the intermediate transfer belt 20. Meanwhile, a recording paper P (an example of the recording medium) is supplied to a gap at which the secondary transfer roller 26 and the intermediate transfer belt 20 are brought into contact with each other at a predetermined timing through a supply mechanism and a secondary transfer bias is applied to the support roller 24. The transfer bias applied at this time has the same polarity (−) as the polarity (−) of the toner, and an electrostatic force directing from the intermediate transfer belt 20 toward the recording paper P acts upon the toner image, whereby the toner image on the intermediate transfer belt 20 is transferred onto the recording paper P. Incidentally, on this occasion, the secondary transfer bias is determined depending upon a resistance detected by a resistance detecting unit (not shown) for detecting a resistance of the secondary transfer portion, and the voltage is controlled.

Thereafter, the recording paper P is sent to a press contact portion (nip portion) of a pair of fixing rollers in a fixing device 28 (an example of the fixing unit), and the toner image is fixed onto the recording paper P to form a fixed image.

Examples of the recording paper P onto which the toner image is transferred include plain paper used for electrophotographic copying machines, printers and the like. As the recording medium, other than the recording paper P, OHP sheets may be used.

The surface of the recording sheet P is preferably smooth in order to further improve smoothness of the image surface after fixing. For example, coating paper obtained by coating a surface of plain paper with a resin or the like, art paper for printing, and the like are preferably used.

The recording paper P in which fixing of a color image is completed is transported to an ejection portion, whereby a series of the color image formation operations end.

Process Cartridge and Toner Cartridge

A process cartridge according to the present exemplary embodiment will be described.

The process cartridge according to the present exemplary embodiment is a process cartridge which includes a developing unit, which accommodates the electrostatic charge image developer according to the present exemplary embodiment and develops an electrostatic charge image formed on an image holding member as a toner image using the electrostatic charge image developer, and is detachable from an image forming apparatus.

Moreover, the configuration of the process cartridge according to the present exemplary embodiment is not limited thereto and may include a developing device and, additionally, at least one selected from other units such as an image holding member, a charging unit, an electrostatic charge image forming unit, and a transfer unit, as necessary.

Hereafter, an example of the process cartridge according to the present exemplary embodiment will be shown and the process cartridge is not limited thereto. Main components shown in the drawing will be described, and the descriptions of the other components will be omitted.

Figure 3:
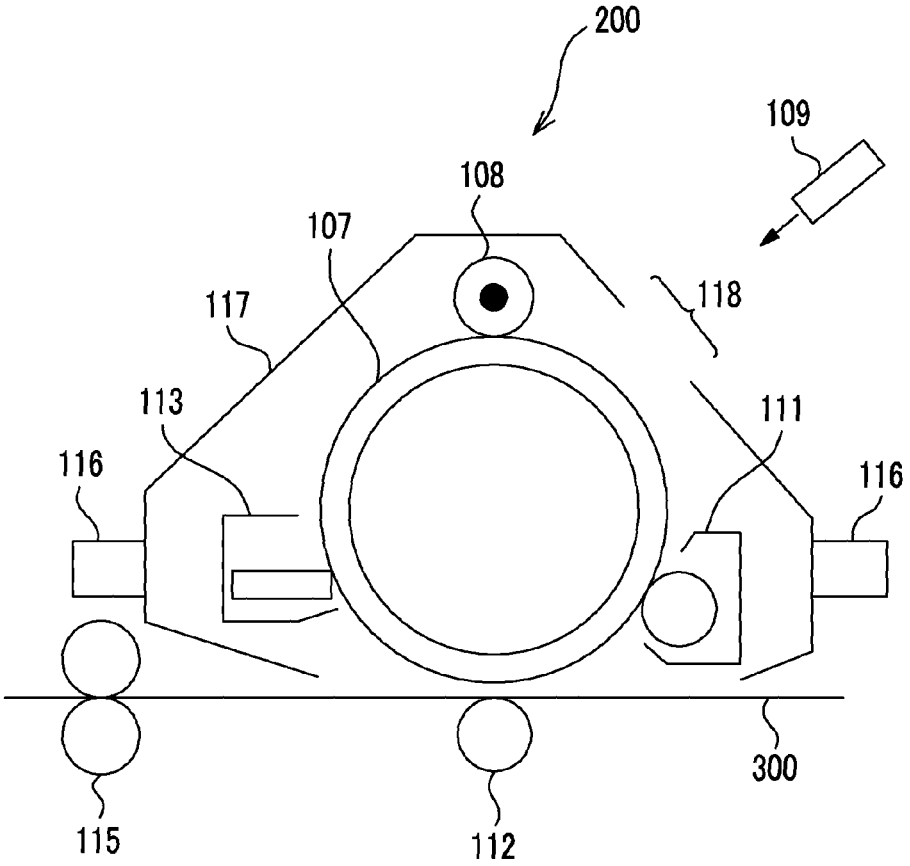
FIG. 3 is a schematic configuration diagram showing an example of a process cartridge according to the exemplary embodiment.

FIG. 3 is a schematic diagram showing a configuration of the process cartridge according to the exemplary embodiment.

A process cartridge 200 shown in FIG. 3 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 3, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment accommodates the toner according to the exemplary embodiment and is detachable from an image forming apparatus. The toner cartridge accommodates a toner for replenishment for being supplied to the developing unit provided in the image forming apparatus.

The image forming apparatus shown in FIG. 2 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, the exemplary embodiment will be described in detail using examples and comparative examples, but is not limited to these examples. Unless specifically noted, "parts" and "%" are based on weight.

Comparative Example 1

Synthesis of Binder Resin

Terephthalic acid: 30 parts by mol

Fumaric acid: 70 parts by mol

Bisphenol A ethylene oxide adduct: 5 parts by mol

Bisphenol A propylene oxide adduct: 95 parts by mol

The above materials are added in a 5-liter flask provided with a stirrer, a nitrogen gas introducing tube, a temperature sensor, and a rectifying column, the temperature is increased to 220° C. for 1 hour, and 1 part of titanium tetraethoxide is added to 100 parts of the above material. The temperature is increased to 230° C. for 0.5 hours while distilling away generated water, a dehydration condensation reaction is continued at this temperature for 1 hour, and then the reactant is cooled, whereby a polyester resin having a weight average molecular weight of 18,000, an acid value of 15 mgKOH/g, and a glass transition temperature of 60° C. is synthesized.

Preparation of Toner 1

Polyester resin: 85 parts

Paraffin Wax (HNP-9 manufactured by Nippon Seiro Co., Ltd.): 5 parts

Carbon black (Regal 330 manufactured by Cabot Corporation): 9 parts

Charge control agent (BONTRON P-51 manufactured by Orient Chemical Industries Co., Ltd.): 1 part The above components are mixed with each other by a 75-L Henschel mixer and kneading is executed under the following conditions, by using a continuous kneader (twin screw extruder) having a screw configuration shown in FIG. 1. A rotating speed of the screw is set to 500 rpm.

Feed portion (blocks 12A and 12B) setting temperature: 20° C.

Kneading portion 1 kneading setting temperature (blocks 12C to 12E): 120° C.

Kneading portion 2 kneading setting temperature (blocks 12F to 12J): 135° C.

Added amount of aqueous medium (distilled water) (with respect to 100 parts of raw material supply amount): 1.5 parts The temperature of the kneaded material at the discharge port (discharge port 18) at this time is 125° C.

This kneaded material is rapidly cooled with a rolling roll in which brine at −5° C. is circulated and a slab insert type cooling belt cooled with cold water at 2° C., and after the cooling, the material is crushed with a hammer mill. The rapid cooling rate is confirmed by changing the speed of the cooling belt and an average temperature falling rate thereof is 10° C./sec.

Then, regarding the toner pulverized using IDS-2 type collision plate type pulverizer (manufactured by Nippon Pneumatic Mfg. Co., Ltd.) with a processing amount of 1.5 kg/h and pulverizing pressure of 0.4 MPa, classification edge is adjusted and changed using Elbow-Jet Air Classifier (manufactured by MATSUBO Corporation), and accordingly fine powder and coarse powder are removed and thus toner particles 1 are obtained. A volume average particle diameter of the toner particles 1 is 8.0 μm, a rate of the toner particles T2 having a particle diameter of 1.0 μm to 2.5 μm occupying the toner particles T1 having a particle diameter of 1.0 μm to 30.0 μm of the toner particles 1 is 5% by number, and a fine particle ratio C is 0.4.

1.0 part of titania particles subjected to isobutyl trimethoxy silane treatment and having a volume average particle diameter of 40 nm is added to and mixed with 100 parts of the obtained toner particles 1 using a sand mill at 6,000 rpm for 60 seconds. Then, 1.0 part of silica particles (R972 manufactured by Nippon Aerosil co., ltd., volume average particle diameter of 16 nm) is added thereto and mixed using a sand mill at 6,000 rpm for 60 seconds, and then sieved using a gyro shifter (aperture: 45 μm), and thus a toner A1 is obtained. A rate of toner particles to which titania particles are attached, among the toner particles T2 having a particle diameter of 1.0 μm to 2.5 μm of the toner A1 is 40% by number, and the number of titania particles attached to one toner particle T2 having a particle diameter of 1.0 μm to 2.5 μm is 50.

Preparation of Magnetic Particle-Containing Carrier (1) Formation of Core

The core is formed by the following method.

After adding 500 parts of spherical magnetite particle powder having a volume average particle diameter of 0.50 μm into a Henschel mixer and sufficiently stirring, 5.0 parts of a titanate coupling agent is added thereto, heated to 100° C. and mixed and stirred for 30 minutes, and thus spherical magnetite particles coated with the titanate coupling agent are obtained. Then, 6.25 parts of phenol, 9.25 parts of 30% formalin, 500 parts of the magnetite particles, 6.25 parts of 25% ammonia water, and 425 parts of water are mixed and stirred in a 1-liter four-necked flask. After heating the mixture to 85° C. for 60 minutes while stirring and causing the mixture to be subjected to the reaction at the same temperature for 120 minutes, the mixture is cooled to 25° C., 500 ml of water is added thereto, a supernatant is removed, and a precipitate is washed. This is dried at a temperature of 150° C. to 180° C. under the reduced pressure and thus core particles having an average particle diameter of 30 μm are obtained.

(2) Formation of Resin Layer (Formation of Recess)

A resin layer having a recess is formed on the surface of the core by the following method.

12 parts of polytetrafluoroethylene resin powder and 0.86 parts of silicon dioxide powder (average particle diameter of 120 nm) obtained by performing surface treatment with polymethyl methacrylate resin are mixed and stirred in a V-blender for 20 minutes. The obtained mixed powder and 400 parts of core particles are added to a dry type multi-function processing apparatus NOBILTA NOB130 (manufactured by Hosokawa Micron Corporation) and processed at 1,000 rpm for 30 minutes. The obtained powder and 1,000 parts of acetone are added in a 2 L vessel having a stirring blades, stirred at 150 rpm for 30 minutes, and subjected to solid-liquid separation using filter paper having aperture of 10 μm. This is dispersed again in 1,000 parts of acetone, stirred at 150 rpm for 30 minutes, and subjected to solid-liquid separation using filter paper having aperture of 10 μm again. Then, vacuum drying is performed for 2 hours and caused to pass through mesh having an aperture of 75 μm and accordingly, a carrier having a volume average particle diameter of 35 μm is obtained.

Preparation of Developer

The carrier and the toner A1 are added in a V-blender at a weight ratio of 95:5 and stirred for 20 minutes, and thus a developer is obtained.

Evaluation

Using DocuCentre Color 500 manufactured by Fuji Xerox Co., Ltd. using a two-component contact development system an P paper manufactured by Fuji Xerox Co., Ltd. in an environment of a low temperature and low humidity (10° C. and 15% RH), a paper feeding running operation of 1,000 sheets is performed by intermittent printing at 2 sheet/14 s of 10 sheets of image having a printing rate of 5% and 10 sheets of image having a printing rate of 1% alternately. Then, a printing sample having a half-tone rate of 50% is printed and evaluation of deletion on the paper is performed based on the following criteria. The obtained results are shown in Table 1.

Measurement of Deletion

A: Absolutely no problems

B: No problems

C: Slight deletion is observed but it is in an acceptable level

D: Determined as defects due to formation of deletion.

Example 1

A toner and a developer according to Example 1 are prepared in the same manner as in Comparative Example 1, except for adjusting the classification edge in the conditions of the air classifier and mixing titania particles in a sample mill at 6,000 rpm for 90 seconds in the addition conditions of the external additive, and the evaluation is performed in the same manner as in Comparative Example 1. The obtained toner particles, characteristics of the toner, and the evaluation result of deletion are shown in Table 1.

Example 2

A toner and a developer according to Example 2 are prepared in the same manner as in Comparative Example 1, except for adjusting the classification edge in the classification conditions of the air classifier and mixing titania particles in a sample mill at 6,000 rpm for 120 seconds in the addition conditions of the external additive, and the evaluation is performed in the same manner as in Comparative Example 1. The obtained toner particles, characteristics of the toner, and the evaluation result of deletion are shown in Table 1.

Example 3

A toner and a developer according to Example 3 are prepared in the same manner as in Comparative Example 1, except for increasing the processed amount to 1.1 times as processed amount that in Comparative Example 1 and adjusting the classification edge in the classification conditions of the air classifier and mixing titania particles in a sample mill at 6,000 rpm for 150 seconds in the addition conditions of the external additive, and the evaluation is performed in the same manner as in Comparative Example 1. The obtained toner particles, characteristics of the toner, and the evaluation result of deletion are shown in Table 1.

Example 4

A toner and a developer according to Example 4 are prepared in the same manner as in Comparative Example 1, except for increasing the processed amount to 1.2 times as processed amount as that in Comparative Example 1 and adjusting the classification edge in the classification conditions of the air classifier and mixing titania particles in a sample mill at 6,000 rpm for 180 seconds in the addition conditions of the external additive, and the evaluation is performed in the same manner as in Comparative Example 1. The obtained toner particles, characteristics of the toner, and the evaluation result of deletion are shown in Table 1.

Comparative Example 2

A toner and a developer according to Comparative Example 2 are prepared in the same manner as in Comparative Example 1, except for increasing the processed amount to 1.3 times as processed amount as that in Comparative Example 1 and adjusting the classification edge in the classification conditions of the air classifier and mixing titania particles in a sample mill at 6,000 rpm for 210 seconds in the addition conditions of the external additive, and the evaluation is performed in the same manner as in Comparative Example 1. The obtained toner particles, characteristics of the toner, and the evaluation result of deletion are shown in Table 1.

Comparative Example 3

A toner and a developer according to Comparative Example 3 are prepared in the same manner as in, except for changing the pulverizing pressure to 0.75 times as pulverizing pressure as that in Comparative Example 1 and adjusting the classification edge in the classification conditions of the air classifier and mixing titania particles in a sample mill at 6,000 rpm for 20 seconds in the addition conditions of the external additive, and the evaluation is performed in the same manner as in Comparative Example 1. The obtained toner particles, characteristics of the toner, and the evaluation result of deletion are shown in Table 1.

Example 5

A toner and a developer according to Example 5 are prepared in the same manner as in Comparative Example 1, except for changing the pulverizing pressure to 0.80 times as pulverizing pressure as that in Comparative Example 1 and adjusting the classification edge in the classification conditions of the air classifier and mixing titania particles in a sample mill at 6,000 rpm for 50 seconds in the addition conditions of the external additive, and the evaluation is performed in the same manner as in Comparative Example 1. The obtained toner particles, characteristics of the toner, and the evaluation result of deletion are shown in Table 1.

Example 6

A toner and a developer according to Example 6 are prepared in the same manner as in Comparative Example 1, except for changing the pulverizing pressure to 0.85 times as pulverizing pressure as that in Comparative Example 1 and adjusting the classification edge in the classification conditions of the air classifier and mixing titania particles in a sample mill at 6,000 rpm for 80 seconds in the addition conditions of the external additive, and the evaluation is performed in the same manner as in Comparative Example 1. The obtained toner particles, characteristics of the toner, and the evaluation result of deletion are shown in Table 1.

Example 7

A toner and a developer according to Example 7 are prepared in the same manner as in Comparative Example 1, except for changing the pulverizing pressure to 0.90 times as pulverizing pressure as that in Comparative Example 1 and adjusting the classification edge in the classification conditions of the air classifier and mixing titania particles in a sample mill at 6,000 rpm for 100 seconds in the addition conditions of the external additive, and the evaluation is performed in the same manner as in Comparative Example 1. The obtained toner particles, characteristics of the toner, and the evaluation result of deletion are shown in Table 1.

Example 8

A toner and a developer according to Example 8 are prepared in the same manner as in Comparative Example 1, except for adjusting the classification edge in the classification conditions of the air classifier and mixing titania particles in a sample mill at 6,000 rpm for 130 seconds in the addition conditions of the external additive, and the evaluation is performed in the same manner as in Comparative Example 1. The obtained toner particles, characteristics of the toner, and the evaluation result of deletion are shown in Table 1.

Comparative Example 4

A toner and a developer according to Comparative Example 4 are prepared in the same manner as in Comparative Example 1, except for changing the pulverizing pressure to 1.05 times as pulverizing pressure as that in Comparative Example 1 and adjusting the classification edge in the classification conditions of the air classifier and mixing titania particles in a sample mill at 6,000 rpm for 160 seconds in the addition conditions of the external additive, and the evaluation is performed in the same manner as in Comparative Example 1. The obtained toner particles, characteristics of the toner, and the evaluation result of deletion are shown in Table 1.

Example 9

A toner and a developer according to Example 9 are prepared in the same manner as in Comparative Example 1, except for decreasing the processed amount to 0.5 times as processed amount as that in Comparative Example 1 and adjusting the classification edge in the classification conditions of the air classifier and mixing titania particles in a sample mill at 6,000 rpm for 50 seconds in the addition conditions of the external additive, and the evaluation is performed in the same manner as in Comparative Example 1. The obtained toner particles, characteristics of the toner, and the evaluation result of deletion are shown in Table 1.

Example 10

A toner and a developer according to Example 10 are prepared in the same manner as in Comparative Example 1, except for decreasing the processed amount to 0.8 times as the processed amount as that in Comparative Example 1 and adjusting the classification edge in the classification conditions of the air classifier and mixing titania particles in a sample mill at 6,000 rpm for 50 seconds in the addition conditions of the external additive, and the evaluation is performed in the same manner as in Comparative Example 1. The obtained toner particles, characteristics of the toner, and the evaluation result of deletion are shown in Table 1.

Example 11

A toner and a developer according to Example 11 are prepared in the same manner as in Comparative Example 1, except for increasing the processed amount to 1.7 times as processed amount as that in Comparative Example 1 and adjusting the classification edge in the classification conditions of the air classifier and mixing titania particles in a sample mill at 6,000 rpm for 40 seconds in the addition conditions of the external additive, and the evaluation is performed in the same manner as in Comparative Example 1. The obtained toner particles, characteristics of the toner, and the evaluation result of deletion are shown in Table 1.

Example 12

A toner and a developer according to Example 12 are prepared in the same manner as in Comparative Example 1, except for increasing the processed amount to 2.3 times as processed amount that in Comparative Example 1 and adjusting the classification edge in the classification conditions of the air classifier and mixing titania particles in a sample mill at 6,000 rpm for 20 seconds in the addition conditions of the external additive, and the evaluation is performed in the same manner as in Comparative Example 1. The obtained toner particles, characteristics of the toner, and the evaluation result of deletion are shown in Table 1.

Comparative Example 5

A toner and a developer according to Comparative Example 5 are prepared in the same manner as in Example 3, except for mixing titania particles simultaneously with silica particles in the addition conditions of the external additive, and the evaluation is performed in the same manner as in Comparative Example 1. The obtained toner particles, characteristics of the toner, and the evaluation result of deletion are shown in Table 1.

Example 13

A toner and a developer according to Example 13 are prepared in the same manner as in Example 3, except for mixing titania particles in a sample mill at 6,000 rpm for 5 seconds in the addition conditions of the external additive, and the evaluation is performed in the same manner as in Comparative Example 1. The obtained toner particles, characteristics of the toner, and the evaluation result of deletion are shown in Table 1.

Example 14

A toner and a developer according to Example 14 are prepared in the same manner as in Example 3, except for mixing titania particles in a sample mill at 6,000 rpm for 10 seconds in the addition conditions of the external additive, and the evaluation is performed in the same manner as in Comparative Example 1. The obtained toner particles, characteristics of the toner, and the evaluation result of deletion are shown in Table 1.

TABLE 1

| | Toner | Volume average particle diameter of toner particles [μm] | From 1.0 μm to 2.5 μm [% by number] | Fine particle ratio C | External additive | Ratio of titania particles attached [% by number] | White points (deletion) |
|---|---|---|---|---|---|---|---|
| Comparative. Example 1 | Toner A1 | 8 | 5 | 0.4 | Silica particles | 40 | D |
| Example 1 | Toner A2 | 8 | 10 | 0.4 | (R972) | 40 | B |
| Example 2 | Toner A3 | 8 | 15 | 0.4 | 1.0% | 40 | A |
| Example 3 | Toner A4 | 8 | 30 | 0.4 | Titania | 40 | A |
| Example 4 | Toner A5 | 8 | 40 | 0.4 | particles | 40 | B |
| Comparative. Example 2 | Toner A6 | 8 | 50 | 0.4 | 1.0% | 40 | D |
| Comparative. Example 3 | Toner A7 | 8 | 20 | 0.1 | | 40 | D |
| Example 5 | Toner A8 | 8 | 20 | 0.18 | | 40 | C |
| Example 6 | Toner A9 | 8 | 20 | 0.2 | | 40 | A |
| Example 7 | Toner A10 | 8 | 20 | 0.3 | | 40 | A |
| Example 8 | Toner A11 | 8 | 20 | 0.4 | | 40 | C |
| Comparative. Example 4 | Toner A12 | 8 | 20 | 0.6 | | 40 | D |
| Example 9 | Toner A13 | 3 | 15 | 0.2 | | 40 | C |
| Example 10 | Toner A14 | 5 | 15 | 0.2 | | 40 | B |
| Example 11 | Toner A15 | 14 | 15 | 0.2 | | 40 | B |
| Example 12 | Toner A16 | 16 | 15 | 0.2 | | 40 | C |
| Comparative. Example 5 | Toner A17 | 8 | 15 | 0.4 | | 9 | D |
| Example 13 | Toner A18 | 8 | 15 | 0.4 | | 10 | C |
| Example 14 | Toner A19 | 8 | 15 | 0.4 | | 20 | B |

In Table 1, the columns of "from 1.0 μm to 2.5 μm" and "rate of titania particles attached" respectively mean the "rate of the toner particles T2 having a particle diameter of 1.0 μm to 2.5 μm occupying the toner particles T1 having a particle diameter of 1.0 μm to 30.0 μm in the toner particles" and the "rate of the toner particles to which at least one kind selected from the group consisting of titania particles and alumina particles among the toner particles T2 having a particle diameter of 1.0 μm to 2.5 μm is attached, to the toner particles".

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles having a volume average particle diameter of 3 μm to 16 μm; and titania particles having a volume average particle size of is 30 nm to 200 nm and/or alumina particles having a volume average particle size of is 30 nm to 200 nm, wherein, when the toner particles having a particle diameter of 1.0 μm to 30.0 μm are set as T1, the toner particles having a particle diameter of 1.0 μm to 2.5 μm are set as T2, a rate of T2 to the toner particles is set as A, the toner particles having a particle diameter of 1.0 μm to 5 μm is set as T3 and a rate of T3 to the toner particles is set as B, the rate of T2 occupying T1 is from 10% by number to 40% by number and a fine particle ratio C represented by A/B is from 0.18 to 0.40.

2. The electrostatic charge image developing toner according to claim 1, further comprising:

an external additive containing silica particles having a volume average particle diameter of 7 nm to 20 nm and at least one kind selected from the group consisting of titania particles and alumina particles, wherein a rate of toner particles to which at least one kind selected from the group consisting of titania particles and alumina particles among T2 is attached is from 10% by number to 100% by number.

3. The electrostatic charge image developing toner according to claim 2, wherein a number of particles of at least one kind selected from the group consisting of titania particles and alumina particles, attached to one toner particle T2 having a particle diameter of 1.0 μm to 2.5 μm is from 1 to 100.

4. The electrostatic charge image developing toner according to claim 1, further comprising:

a polyester resin as a binder resin.

5. The electrostatic charge image developing toner according to claim 4, wherein the polyester resin has a glass transition temperature (Tg) of 50° C. to 80° C.

6. The electrostatic charge image developing toner according to claim 4, wherein the polyester resin has a weight average molecular weight (Mw) of 5,000 to 1,000,000.

7. The electrostatic charge image developing toner according to claim 4, wherein the polyester resin has a number average molecular weight (Mn) of 2,000 to 100,000.

8. The electrostatic charge image developing toner according to claim 4, wherein the polyester resin has molecular weight distribution (Mw/Mn) of 1.5 to 100.

9. The electrostatic charge image developing toner according to claim 4, wherein a content of the binder resin is 40% by weight to 95% by weight with respect to the entirety of toner particles.

10. The electrostatic charge image developing toner according to claim 1, further comprising:

a colorant, wherein a content of the colorant is from 1% by weight to 30% by weight with respect to the entirety of toner particles.

11. The electrostatic charge image developing toner according to claim 1, further comprising:

a release agent, wherein a content of the release agent is from 1% by weight to 20% by weight with respect to the entirety of toner particles.

12. The electrostatic charge image developing toner according to claim 1, wherein the toner particles have a shape factor SF1 of 110 to 150.

13. The electrostatic charge image developing toner according to claim 2, wherein an amount of the external additive externally added is 0.01% by weight to 5% by weight with respect to the toner particles.

14. An electrostatic charge image developer comprising:

the electrostatic charge image developing toner according to claim 1; and a carrier.

15. The electrostatic charge image developer according to claim 14, wherein the carrier contains a core whose surface is coated with a coating resin.

16. The electrostatic charge image developer according to claim 15, wherein conductive particles are contained in the coating resin.

17. The electrostatic charge image developer according to claim 14, wherein the carrier has a volume average particle diameter of 15 μm to 50 μm.

18. A toner cartridge which accommodates the electrostatic charge image developing toner according to claim 1 and is detachable from an image forming apparatus.

* * * * *